US006078240A

United States Patent [19]

Huang

[11] Patent Number: 6,078,240

[45] Date of Patent: Jun. 20, 2000

[54] ISOLATING COVER FOR TRANSFORMER

[76] Inventor: Ming Shih Huang, No. 6, Lane 51, Chung Hsing Road, Sec.1, Wu Ku Taipei Hsien, Taiwan

[21] Appl. No.: 09/306,776

[22] Filed: May 7, 1999

[51] Int. Cl.[7] ..... H01F 27/02

[52] U.S. Cl. ..... 336/90; 336/65; 336/92; 336/198; 336/208

[58] Field of Search ..... 336/192, 198, 336/65, 92, 208, 210, 90, 98

[56] References Cited

U.S. PATENT DOCUMENTS 5,534,839 7/1996 Mackin et al. ..... 336/192
5,859,577 1/1999 Nihei et al. ..... 336/92

*Primary Examiner*—Lincoln Donovan
*Assistant Examiner*—Tuyen Nguyen
*Attorney, Agent, or Firm*—Dougherty & Troxell

[57] ABSTRACT

An isolating cover for mounting on a top of a bobbin of a small-scaled transformer to cover windings and pins provided on the bobbin and isolate them from a frame core of the transformer. The isolating cover is so designed that it has isolating walls to provide increased creepage distances between any two components on the transformer and therefore prevents a hipot from directly crossing from a high-tension end to a low-tension end on the transformer. The increased creepage distances at all areas of the bobbin enable upgraded quality and reliability of the transformer. The isolating cover can be easily mounted to the bobbin to replace conventional insulating tape for covering the top of the bobbin, and has dimensions that do not exceed an overall volume defined by the bobbin. The transformer with the isolating cover can therefore be manufactured with simplified procedures and at reduced cost.

3 Claims, 6 Drawing Sheets

ISOLATING COVER FOR TRANSFORMER

BACKGROUND OF THE INVENTION

The present invention relates to an isolating cover for transformer, and more particularly to a cover for transformer to increase creepage distances between bobbin and frame core of the transformer in all directions. The isolating cover for transformer is a plastic member integrally formed by injection molding and includes many isolating walls at different positions thereon to completely prevent a hipot from directly crossing over a conductive metal component between high-tension and low-tension ends. The isolating cover can be easily assembled to the transformer to protectively cover a top of the bobbin and can therefore replace a conventionally used insulating tape. The transformer can therefore have simplified manufacturing process and improved quality.

Transformers are required components in electronic circuits. Since circuit boards used in the existing electronic products are very thin, small and light in volume, transformers used for constructing the circuit boards must also have largely reduced size. However, all transformers mainly structurally include a bobbin, multiple pins, at least a core, and at least a winding. With different arrangements of these components, transformers of different shape, specification and function may be produced.

Wherein, the winding may be a dual winding including an inner and an outer windings or a multi-slot winding, and the core may be formed from two E-shaped members or a central I core and a frame core. While transformers may be differently structured, they all have to comply with relevant safety codes specifying safe and protective requirements thereof. Among the safety codes, there is one particularly concerning "creepage distance". The creepage distance may be 1.6 mm, 2.5 mm or other length, depending on grades, such as A or B grade, specified in the safetycodes. The purpose of creepage distance is to define a safety distance between two metal components so as to prevent a hipot at a high-tension end from directly crossing over a conductive metal component to a lower-tension end and resulting in damages, such as short circuit, to circuit at the low-tension end. Such safety distance must exist in many areas on a transformer, including areas between the winding and the core, the pins and the winding, and/or the pins and the core.

For the currently commercially available transformers of different specifications, there are different isolating means separately provided to achieve required safety distances between different components. However, being limited by the required small volume of transformer, such isolating means are usually designed only to increase the creepage distance at a certain particular area of the transformer and do not have other functions.

SUMMARY OF THE INVENTION

It is therefore a primary object of the present invention to provide an isolating cover for covering a bobbin of a transformer so that isolating walls formed on the isolating cover increase creepage distances between a frame core and pins on the bobbin without increasing overall dimensions of the transformer.

Another object of the present invention is to provide an isolating cover that has a rectangular housing portion for directly covering multiple winding slots of a bobbin of a transformer, so that all windings on the bobbin are isolated from outside. The isolating cover therefore replaces conventional insulating tape for sealing an open top of the bobbin, and the transformer can therefore be manufactured with simplified procedures and at reduced cost.

A further object of the present invention is to provide a transformer isolating cover that includes a rectangular housing portion having a flat and smooth top surface on which specification and serial number of an individual transformer may be stamped or printed. The flat and smooth top of the isolating cover also serves as a vacuum pressure suck surface required by a robot in automated production to hold the bobbin.

DETAILED DESCRIPTION OF THE PREFERRED EMBODIMENTS

Figure 1:
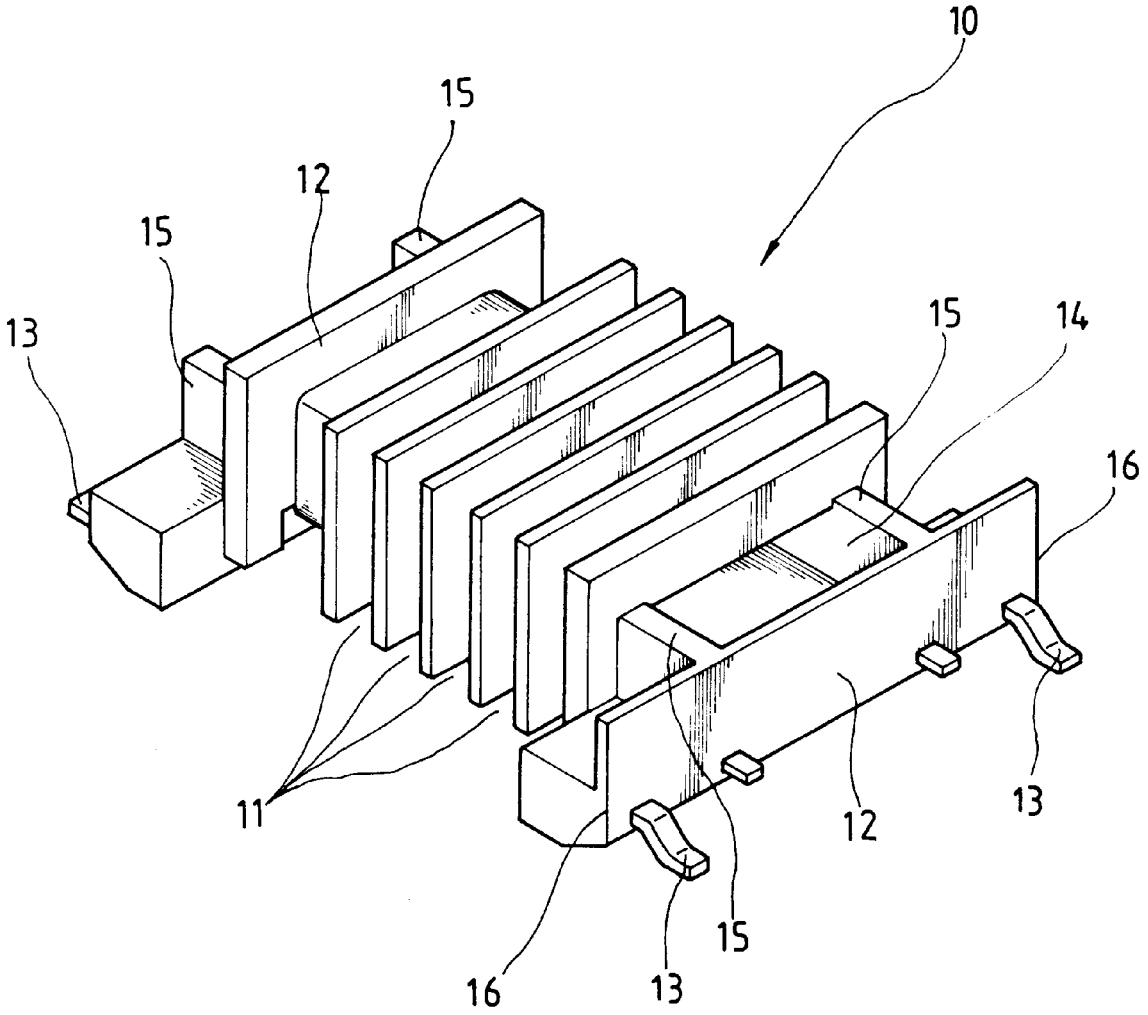
FIG. 1 (PRIOR ART)
FIG. 1 is a perspective view of a conventional bobbin for a transformer.

Please refer to FIG. 1 that is a perspective view of a conventional bobbin 10 for a transformer. The bobbin 10 is integrally formed and includes multiple winding slots 11 for each accommodates a winding (not shown) therein. There are pins 13 outward projected from outer sides of front and rear ends surfaces 12 of the bobbin 10 and electrically connected to the windings (not shown). A middle mounting hole 14 is formed at a central portion of the bobbin 10 for a central core or I core (not shown) to mount therein. A frame core (not shown) maybe horizontally positioned around the multiple winding slots 11 to locate in spaces between inner sides of the front and rear end surfaces 12 and outer sides of four longitudinal stopping walls 15 on the bobbin 10.

The front and the rear end surfaces 12 and the stopping walls 15 all serve as isolating means on the bobbin 10 to create sufficient creepage distance to meet requirements set by the safety code. However, a creepage distance between the windings in the multiple winding slots 11 and the frame core is apparently insufficient. And, a creepage distance between the pins 13 and the frame core seems to be long enough if vertically measured along the end surfaces 12, but apparently insufficient if horizontally measured along outer corners 16 of the end surfaces 12.

Moreover, to fully complete a transformer having a bobbin 10 with multiple winding slots 11 that cause the transformer to be upward opened, it is necessary to cover a top of the transformer with insulating tape.

Figure 2:
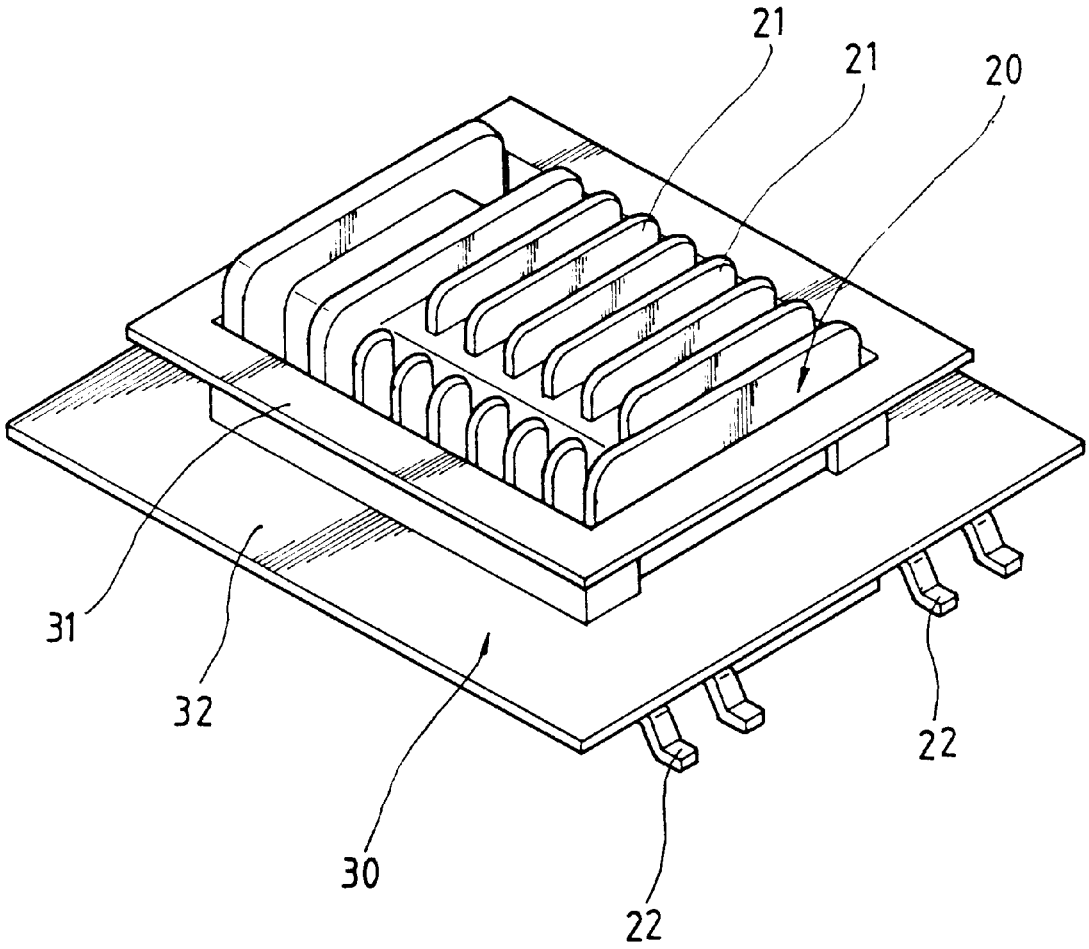
FIG. 2 (PRIOR ART)
FIG. 2 is a perspective view of another conventional bobbin for a transformer.
Figure 3:
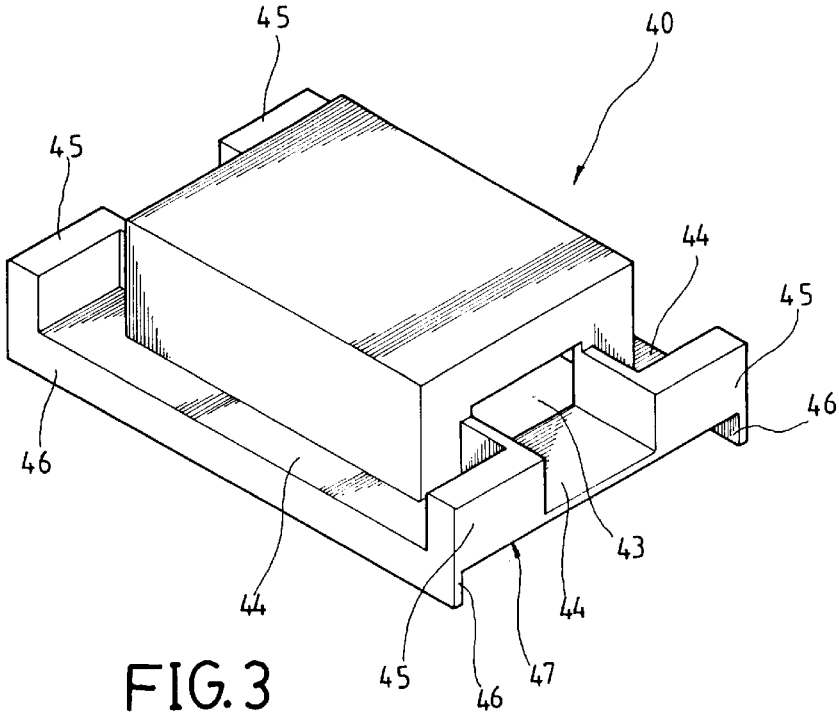
FIG. 3 is a perspective view of an isolating cover for transformer according to the present invention.
Figure 5:
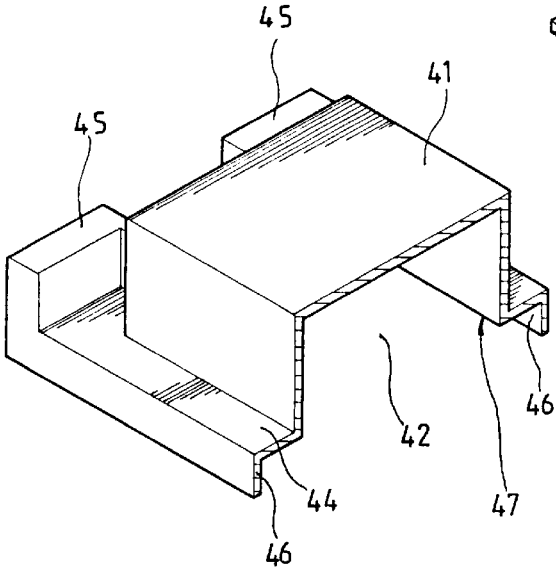
FIG. 5 is another perspective view of the isolating cover of FIG. 3 being transversely cut to show an internal structure thereof.
Figure 4:
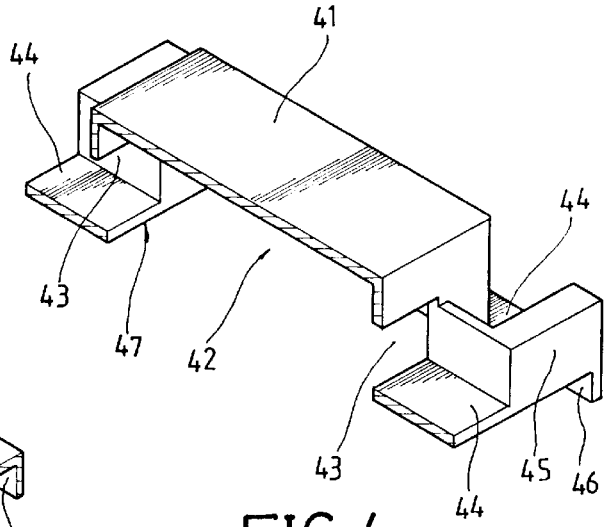
FIG. 4 is a perspective view of the isolating cover of FIG. 3 being longitudinally cut to show an internal structure thereof.

FIG. 2 illustrates another conventional bobbin 20 for a transformer. The bobbin 20 also includes multiple winding slots 21 and pins 22. A double-flange frame 30 including an upper flange 31 and a lower flange 32 is mounted around the bobbin 20, so that two substantially E cores (not shown) can be mounted between the upper and the lower flanges 31 and 32, respectively, of the double-flange frame 30 separately from a front and a rear end of the bobbin 20. To create sufficient creepage distances on the bobbin 20, both the upper and the lower flanges 31, 32 must have a considerably large width that would inevitably increase overall dimensions of the fully completed transformer, making the transformer no longer thin, small and light. Another disadvantage of the double-flange frame 30 is that it can not be easily picked up by a robot due to its irregular profile and is therefore not suitable for use in an automated mass production. Again, windings on the bobbin 20 are upward open to outside and must be covered with insulating tape.

Figure 6:
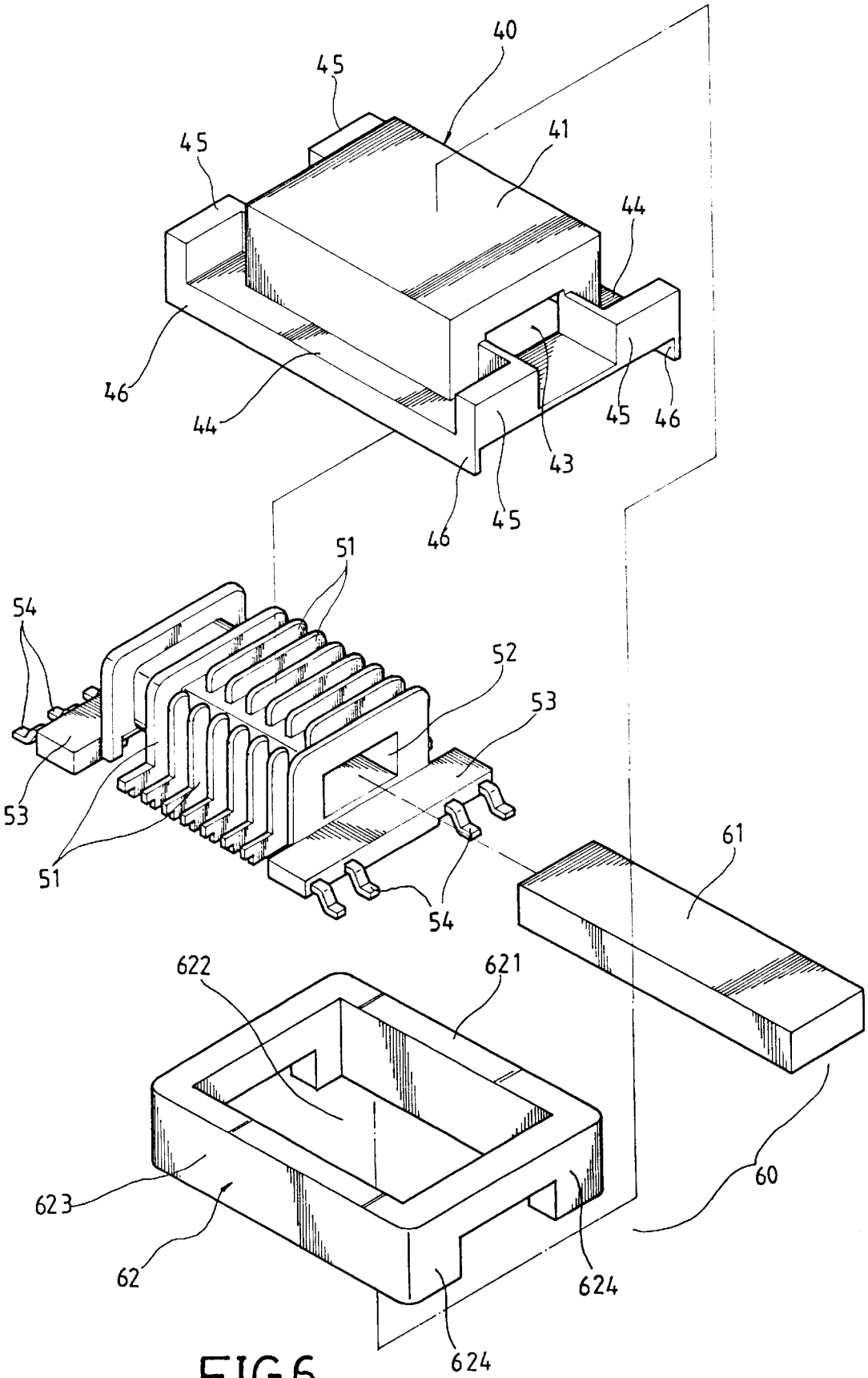
FIG. 6 is an exploded perspective view of a transformer showing the manner in which the isolating cover of the present invention and other components are assembled to form the transformer.

Please now refer to FIGS. 3 through 7 that show an isolating cover 40 according to an embodiment of the present invention designed to cover a bobbin 50 generally similar to that shown in FIG. 6. The bobbin 50 is a common standardized product and has a multi-slot winding portion with a plurality of winding slots 51 provided thereon for each accommodating a winding therein. The multi-slot winding portion defines an internal middle mounting hole 52 for receiving an I core 61 therein. Two flat plates 53 separately extend from front and rear ends of the winding portion, and pins 54 are embedded in the flat plates 53 with front ends of the pins 54 projected from end surfaces of the flat plates 53. A frame core 62, that together with the I core 61 form a core 60 of a transformer, is horizontally positioned around the winding portion and seated on the two flat plates 53.

The isolating cover 40 is a hollow member including a middle rectangular housing portion 41 that defines an internal chamber 42. The chamber 42 has dimensions that are suitable to fully cover the multi-slot winding portion 51 and all windings wound thereabout. The rectangular housing portion 41 is provided at front and rear ends with a rectangular opening 43 each corresponding to the middle mounting hole 52 of the winding portion, so that the I core 61 may be mounted in the middle mounting hole 52 via the rectangular openings 43. Flanges 44 in the same plane horizontally and outward extend from four lower peripheral edges of the rectangular housing portion 41. Two pairs of vertically and upward extended L-shaped walls 45 are separately provided on two flanges 44 at the front and the rear ends of the housing portion 41. Longitudinal sections of the L-shaped walls 45 are separately ended at vertical edges of the rectangular openings 43, and transverse sections of the L-shaped wall 45 extend along outer edges of the front and the rear flanges 44 to end at corners at where two adjacent flanges 44 meet one another. The walls 45 may have increased thickness to create longer creepage distance. Moreover, there are two vertically and downward projected walls 46 extending along outer edges of two lateral flanges 44. Both the upward walls 45 and the downward walls 46 are isolating walls to help a completed transformer to meet required safety creepage distance in all directions.

Figure 7:
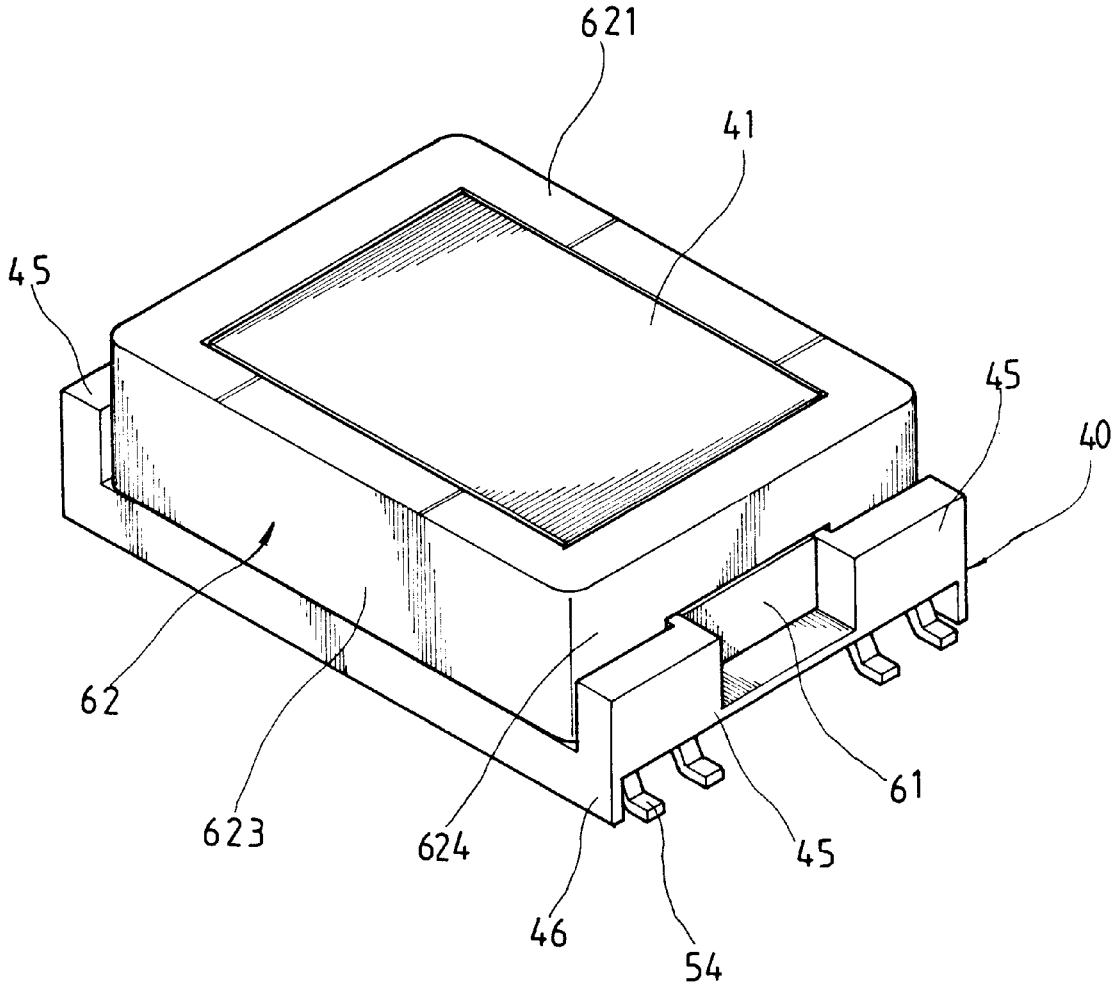
FIG. 7 is an assembled perspective view of the transformer of FIG. 6.

To assemble the bobbin 50 already having windings wound thereabout, the I core 61, and the frame core 62 together to form a transformer, the isolating cover 40 is first covered onto the bobbin 50, then the I core 61 is mounted in the central mounting hole 52 via one of the rectangular openings 43 with two ends of the I core 61 projected from the rectangular openings 43. At this point, the isolating cover 40 and the bobbin 50 are associated with one another by the I core 61 to form a unitary body. Thereafter, the frame core 62 is horizontally positioned around the isolating cover 40 to complete the transformer. An optimal transformer assembled from the above steps is shown in FIG. 7. As shown, a top surface 621 of the frame core 62 is flush with a top surface of the rectangular housing portion 41 of the isolating cover 40, a rectangular top central opening 622 formed on the top surface 621 of the frame core 62 fitly contacts with outer peripheries of the housing portion 41, two vertical side surfaces 623 of the frame core 62 are separately flush with outer surfaces of the two downward walls 46, and front and rear end surfaces 624 of the frame core 62 separately fitly abut against inner surfaces of the L-shaped upward walls 45. Moreover, a bottom surface 47 of the isolating cover 40 (see FIGS. 3, 4 and 5) is fitly seated on the front and the rear flat plates 53 of the bobbin 50. What is to be noted is the front and rear flanges 44 of the isolating cover 40 have end surfaces extend beyond the end surfaces of the flat plates 53 for a small distance and the two downward walls 46 also extend beyond a bottom of the flat plates 53 for a small distance, such that pins 54 projected from the end surfaces of the flat plates 53 are located below and shielded by the isolating cover 40. This arrangement further provides increased creepage distance between the pins 54 and the frame core 62.

From the above description, it can be seen that the walls on the isolating cover 40, including the upward and the downward walls 45 and 46, respectively, together constitute an all-direction stopper to completely prevent any undesired crossing of hipot over two components of the resultant transformer. The resultant transformer can therefore have upgraded quality of reliability. Moreover, the isolating cover 40 has dimensions that do not exceed overall dimensions of the resultant transformer defined by the pins 54 and the frame core 62 of the transformer. That is, the isolating cover 40 according to the present invention is capable of providing an anticipated isolating effect while it effectively maintains the originally very small volume allowed for the transformer. The isolating cover 40 is therefore an excellent design to enable a transformer to meet regulations of the Safety Codes concerning required creepage distances.

Figure 8:
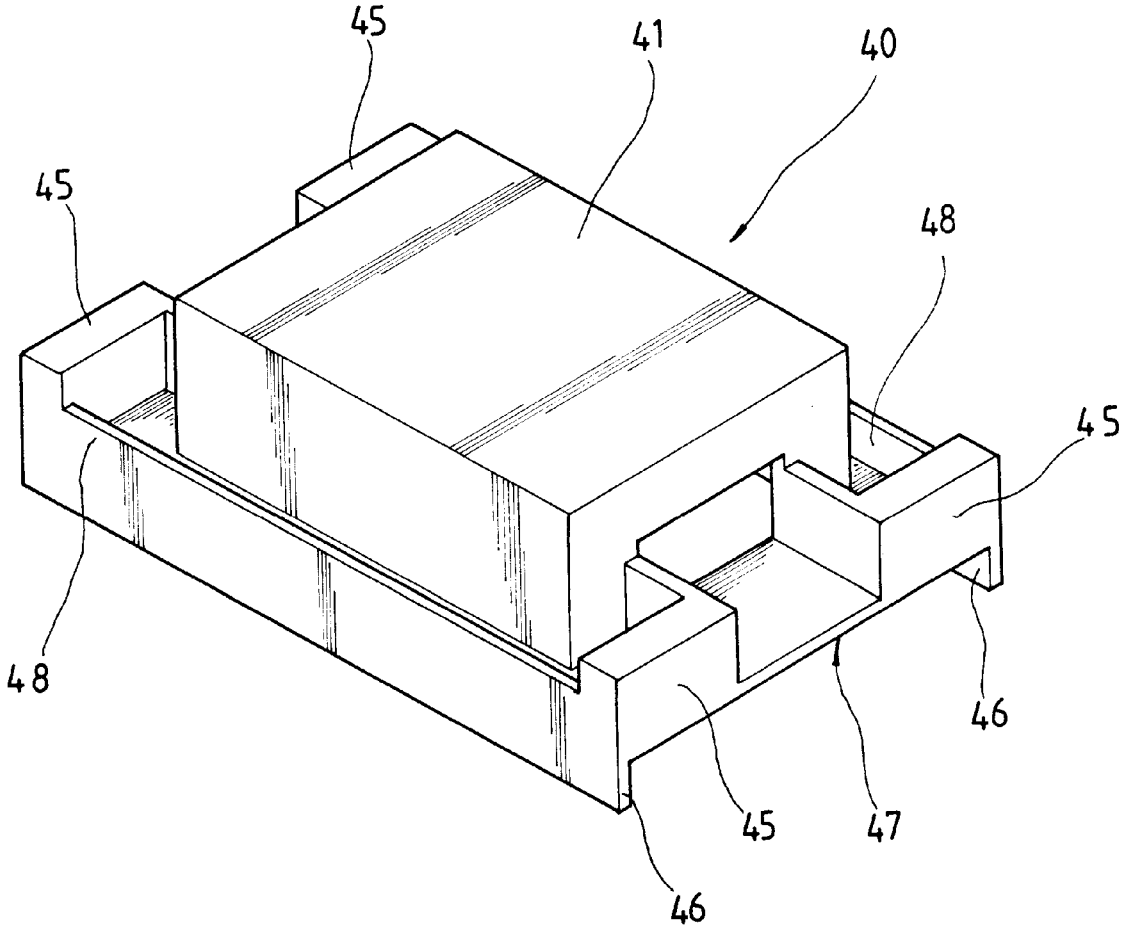
FIG. 8 is an isolating cover according to a variant of the present invention.

FIG. 8 illustrates a variant of the isolating cover 40 of the present invention. In this variant, the isolating cover 40 includes more isolating walls in addition to the rectangular housing portion 41, the upward walls 45, and the downward walls 46. These additional isolating walls include, but not limited to, a straight upward wall 48 located at outer edge of each lateral flange 44 of the isolating cover 40 to extend between a front and a rear L-shaped upward walls 45. The straight and the L-shaped upward walls 48 and 45, respectively, together form a continuous and complete wall that encloses the frame core 62 and further ensures safe creepage distances on the resultant transformer in all directions thereof. The straight upward walls 48 may have a thickness designed depending on a width of the frame core 62 or of the flanges 44. The variant of the isolating cover 40 shown in FIG. 8 can be easily formed without adversely affecting the function of the resultant transformer. Such variant is therefore functionally equivalent to the isolating cover 40 shown in FIGS. 3 through 7 and should be included in the scope of the present invention.

What is claimed is:

1. A transformer comprising:

a) a bobbin with a plurality of winding slots with windings located therein, the bobbin having a middle mounting hole open at opposite ends, flat plates extending from opposite ends of the bobbin adjacent to the openings of the middle mounting hole, and a plurality of pins extending from each flat plate;

b) an isolating cover formed of an electrically insulating material and having: a housing portion comprising a plurality of sidewall portions and a top wall portion joined with the sidewall portions to bound an internal chamber having an open bottom, opposite sidewall portions each having an opening therethrough; a lateral flange extending laterally outwardly from the housing portion; and a plurality of L-shaped walls extending upwardly from the lateral flange, the L-shaped walls each having two legs, one of the legs of each of the L-shaped walls aligned with a side of one of the openings through the opposite sidewalls of the housing portion and the other of the two legs being spaced from the housing portion, the isolating cover mounted on the bobbin such that at least a portion of the lateral flange rests on the flat plates whereby the plurality of winding slots are located in the internal chamber so as to be covered by the top wall portion and sidewall portions, and the openings through the opposite sidewall portions are aligned with the middle mounting hole of the bobbin, the lateral flange extending over at least a portion of the plurality of pins;

c) an I core located in the middle mounting hole; and, d) a frame core located on at least a portion of the lateral flange, the frame core having central frame core opening into which the housing portion extends such that the top wall portion is flush with a top surface of the frame core.

2. The transformer of claim 1 further comprising a projecting wall extending from at least a portion of a distal edge of the lateral flange.

3. The transformer of claim 2 wherein the projecting wall extends from the lateral flange in a direction opposite from the sidewall portions of the housing.

* * * * *